US007815489B2

(12) United States Patent
Pietsch et al.

(10) Patent No.: US 7,815,489 B2
(45) Date of Patent: Oct. 19, 2010

(54) METHOD FOR THE SIMULTANEOUS DOUBLE-SIDE GRINDING OF A PLURALITY OF SEMICONDUCTOR WAFERS

(75) Inventors: Georg Pietsch, Burghausen (DE); Michael Kerstan, Burghausen (DE); Heiko aus dem Spring, Weilburg (DE)

(73) Assignees: Siltronic AG, Munich (DE); Peter Wolters GmbH, Rendsburg (DE)

( * ) Notice: Subject to any disclaimer, the term of this patent is extended or adjusted under 35 U.S.C. 154(b) by 543 days.

(21) Appl. No.: 11/774,675

(22) Filed: Jul. 9, 2007

(65) Prior Publication Data

US 2008/0014839 A1 Jan. 17, 2008

(30) Foreign Application Priority Data

Jul. 13, 2006 (DE) ..... 10 2006 032 455

(51) Int. Cl.
*B24B 49/00* (2006.01)
*B24B 51/00* (2006.01)

(52) U.S. Cl. ..... 451/7; 451/8; 451/53; 451/56; 451/57; 451/63; 451/261; 451/269

(58) Field of Classification Search ..... 216/88; 438/692; 451/5, 7, 8, 11, 53, 56, 72, 57, 451/58, 63, 443, 261, 262, 264, 267, 268, 451/269

See application file for complete search history.

(56) References Cited

U.S. PATENT DOCUMENTS 5,113,622 A 5/1992 Nishiguchi et al.
5,364,655 A * 11/1994 Nakamura et al. ..... 427/129
5,863,306 A 1/1999 Wei et al.
6,007,407 A 12/1999 Rutherford et al.
6,095,898 A * 8/2000 Hennhofer et al. ..... 451/7
6,179,950 B1 1/2001 Zhang et al.
6,257,961 B1 * 7/2001 Suzuki et al. ..... 451/41
6,299,514 B1 10/2001 Boller
6,454,644 B1 * 9/2002 Miyazaki et al. ..... 451/526

(Continued)

FOREIGN PATENT DOCUMENTS

CN 1610069 A1 4/2005

(Continued)

OTHER PUBLICATIONS

Thomas Ardelt, Berichte aus dem Produktionstechnischen Zentrum Berlin, Fraunhofer Institut fur Produktionsanlagen und Konstruktionstechnik, IPK Berlin, 2001, pp. 37-53.

(Continued)

*Primary Examiner*—Timothy V Eley
(74) *Attorney, Agent, or Firm*—Brooks Kushman P.C.

(57) ABSTRACT

A method for the simultaneous double-side grinding of a plurality of semiconductor wafers, involves a process wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive. The method according to the invention makes it possible, by means of specific kinematics, to produce extremely planar semiconductor wafers.

24 Claims, 5 Drawing Sheets

U.S. PATENT DOCUMENTS

| | | | | |
|---|---|---|---|---|
| 6,599,177 | B2 | 7/2003 | Nevoret et al. | |
| 6,645,862 | B2 * | 11/2003 | Wenski et al. | 438/691 |
| 6,793,837 | B2 * | 9/2004 | Wenski et al. | 216/88 |
| 7,101,258 | B2 * | 9/2006 | Ising | 451/7 |
| 2003/0054650 | A1 | 3/2003 | Wenski et al. | |
| 2004/0229548 | A1 | 11/2004 | Kann et al. | |
| 2005/0276979 | A1 * | 12/2005 | Slutz et al. | 428/408 |

FOREIGN PATENT DOCUMENTS

| | | | |
|---|---|---|---|
| DE | 10007390 | | 10/2000 |
| DE | 19954355 | | 5/2001 |
| DE | 10162597 | | 3/2003 |
| DE | 10344602 | | 5/2005 |
| JP | 2000271857 | A | 10/2000 |
| JP | 02218557 | | 8/2001 |
| JP | 2001219362 | | 8/2001 |
| JP | 2005059175 | A | 3/2005 |
| WO | WO 9519242 | | 7/1995 |
| WO | WO 9924218 | | 7/1995 |

OTHER PUBLICATIONS

English Derwent Abstract AN 2005-387575 corresponds to DE 10344602A1.

English Derwent Abstract AN 2001-617985 corresponds to DE 19954355A1.

English Derwent Abstract AN 2003-231546 corresponds to DE 10162597C1.

Patent Abstracts of Japan corresponds to JP 02-218557.

Patent Abstracts of Japan corresponds to JP 2001-219362 A.

* cited by examiner

Fig. 8A $$\begin{pmatrix} n_o \\ n_u \\ n_i \\ n_a \end{pmatrix} = \begin{pmatrix} 30 \\ -36 \\ -46 \\ 12 \end{pmatrix} \Rightarrow \begin{pmatrix} \sigma_o \\ \sigma_u \\ \omega_o \\ \omega_u \end{pmatrix} = \begin{pmatrix} -33.2 \\ 32.8 \\ 14.0 \\ 80.0 \end{pmatrix}$$

Fig. 8B $$\begin{pmatrix} n_o \\ n_u \\ n_i \\ n_a \end{pmatrix} = \begin{pmatrix} 25 \\ -59 \\ -43 \\ -8 \end{pmatrix} \Rightarrow \begin{pmatrix} \sigma_o \\ \sigma_u \\ \omega_o \\ \omega_u \end{pmatrix} = \begin{pmatrix} -42.2 \\ 41.8 \\ -13.7 \\ 70.3 \end{pmatrix}$$

Fig. 9A

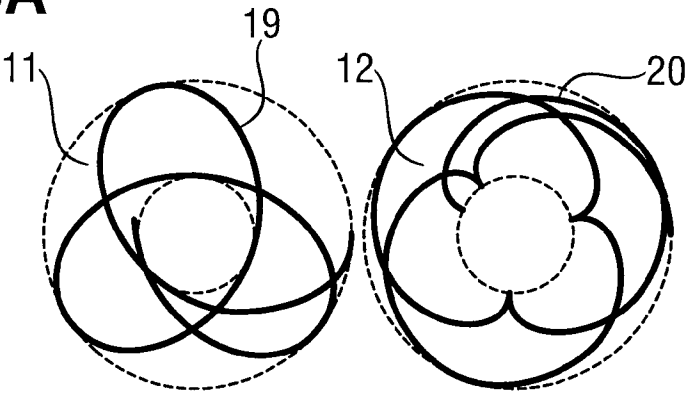

Fig. 9B

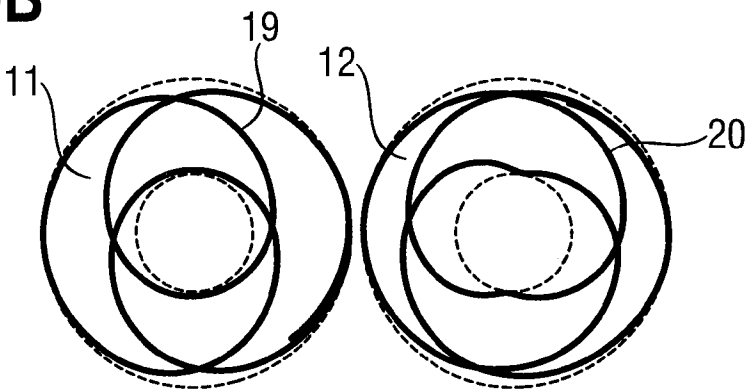

METHOD FOR THE SIMULTANEOUS DOUBLE-SIDE GRINDING OF A PLURALITY OF SEMICONDUCTOR WAFERS

BACKGROUND OF THE INVENTION

1. Field of the Invention

The subject matter of the present invention is directed to a method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive. The subject matter of the invention is also a semiconductor wafer having outstanding flatness which can be produced by means of the method.

2. Background Art

Electronics, microelectronics and microelectromechanics require as starting materials (substrates), semiconductor wafers with extreme requirements for global and local flatness, single-side-referenced local flatness (nanotopology), roughness, and cleanliness. Semiconductor wafers are wafers made of semiconductor materials, in particular compound semiconductors such as gallium arsenide, and particularly elemental semiconductors such as silicon and occasionally germanium. If necessary, layer structures are provided on the semiconductor wafers before they are used for producing components. Layer structures are, e.g., a device-carrying silicon upper layer on an insulator ("silicon on insulator", SOI), or a strained silicon-germanium layer ("strained silicon") on a silicon wafer or combinations of the two ("strained silicon on insulator", sSOI).

In accordance with the prior art, semiconductor wafers are produced in a multiplicity of successive process steps which can generally be classified into the following groups:

a) production of a monocrystalline semiconductor ingot (crystal growth);
b) separation of the ingot into individual wafers;
c) mechanical machining;
d) chemical machining;
e) chemomechanical machining; and
f) when necessary, production of layer structures.

The combination of the individual steps allotted to the groups, as well as their order, may vary depending on the intended application. A multiplicity of secondary steps such as cleaning, sorting, measuring, packaging, etc. are furthermore used.

Mechanical machining serves to remove undulations that arose during the preceding separation of the semiconductor ingot, for example as a result of thermal drift over a long duration of separation or dynamic self-dressing and -blunting processes. Furthermore, mechanical machining serves for the removal of the surface layer damaged in crystalline fashion by the rough sawing process, and for reduction of the surface roughness. Primarily, however, mechanical machining is used for global leveling of the semiconductor wafer. Various techniques are used in accordance with the prior art, for example, lapping (double-side plane lapping using free abrasive grain), single-side grinding using a cup grinding disk ("single-side grinding", SSG), or simultaneous double-side grinding between two cup grinding disks on the front and rear sides simultaneously ("double-disk grinding", DDG).

DE 10344602 A1 describes a method which combines the kinematics known from lapping and constrained-force-free guidance with the advantages of bonded abrasive grain. In this case, the semiconductor wafers are generally moved with a plurality of carriers between an upper and a lower working disk. The two working disks have an abrasive cloth applied to them, by way of example. As in the case of a lapping machine, the carriers, which in each case have a plurality of cutouts for receiving the semiconductor wafers, are in engagement with a rolling apparatus, comprising an inner and an outer drive ring, via a toothed ring, and are caused to effect a rotary movement about their axis and about the axis of the drive rings by means of the apparatus, such that the semiconductor wafers describe cycloidal paths relative to the working disks which likewise rotate about their axis.

It has been found, however, that the semiconductor wafers machined by this method have a series of defects, with the result that the wafers are unsuitable for particularly demanding applications. It has been shown, for example, that generally semiconductor wafers are produced with a disadvantageous convex thickness profile and a pronounced edge roll-off. The semiconductor wafers also often have irregular undulations in their thickness profile and also a rough surface with a large damage depth. Damage depth should be understood to mean the depth, calculated from the surface of the semiconductor wafer, to which the crystal lattice was damaged, i.e. disturbed, by the machining.

Rough semiconductor wafers with large damage depth require complex remachining that nullifies the advantages of the method disclosed in DE 10344602 A1. It is virtually impossible or possible only with high outlay to convert convex semiconductor wafers into the desired plane-parallel target form by means of the customary chemical and chemomechanical subsequent machining. The remaining convexity and edge roll-off lead to incorrect exposures during photolithographic device patterning and hence to the failure of the components. Semiconductor wafers of this type are therefore unsuitable for demanding applications.

SUMMARY OF THE INVENTION

It is an object of the present invention, therefore, to provide semiconductor wafers which, on account of their geometry, are also suitable for producing electronic components with very small linewidths ("design rules"). A further object was to prevent edge roll-off from arising during the production of semiconductor wafers, and a yet further object was to avoid other geometrical faults such as a thickness maximum in the center of the semiconductor wafer associated with a continuously decreasing thickness toward the edge of the wafer or a local thickness minimum in the center of the semiconductor wafer. These and other objects, separately or together, are surprisingly met by the process of the invention.

BRIEF DESCRIPTION OF THE DRAWINGS

FIG. 8 illustrates machine settings (rotational speed sets) and resulting invariant parameter sets (concomitantly rotating reference system). (A): for a method not according to the invention; (B): a method according to the invention comprising the features of the second, third and fourth embodiments.

FIG. 9 represents the trajectories 19 with respect to an upper working disk and trajectories 20 with respect to a lower working disk, which are associated with the parameter sets from FIG. 8. (A): for a method not carried out according to the invention; (B): a method according to the invention comprising the features of the second, third and fourth embodiments.

LIST OF REFERENCE SYMBOLS AND ABBREVIATIONS USED

Figure 3:
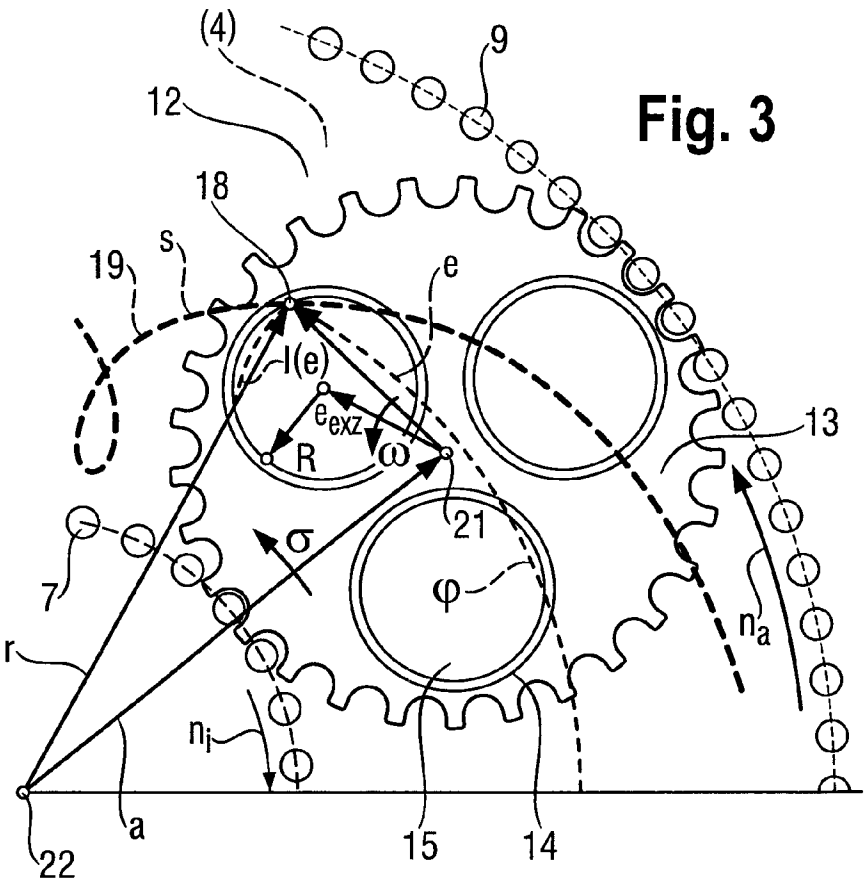
FIG. 3 illustrates the designation and assignment of characteristic elements in one embodiment with respect to the movement sequence (kinematics).

1 Upper working disk
4 Lower working disk
5 Rotary axle of the working disks
7 Inner drive ring
9 Outer drive ring
11 Upper working layer
12 Lower working layer
13 Carrier
14 Cutout in carrier for receiving the semiconductor wafer
15 Semiconductor wafer
16 Midpoint of the semiconductor wafer
17 Pitch radius of the midpoints of the carriers in rolling apparatus
18 Reference point of the semiconductor wafer
19 Trajectory of the reference point of the semiconductor wafer on lower working disk
20 Trajectory of the reference point of the semiconductor wafer on upper working disk
21 Midpoint of the carrier
22 Midpoint of the rolling apparatus
24 Edge region of reduced thickness of the semiconductor wafer
25 Wear of the upper working layer
26 Wear of the lower working layer
27 Region of very high local wear of the working layer
28 Region of very high difference in the local wear of the working layers
29 Difference in the wear of upper and lower working layer
30 Working gap
33 Convexity of the semiconductor wafer
34 Coolant/lubricant passages
35 Isotropic cumulated distribution of the machining traces (grinding marks)
36 Anisotropic cumulated distribution of the machining traces (grinding marks)
A.S.A. Wear of the working layer
α Distance between the midpoint of the carrier and the midpoint of the rolling apparatus
ΔA.S.A. Difference in the wear of upper and lower working layer
e Distance between the reference point of the semiconductor wafer and the midpoint of the carrier
$e_{ecc}$ Distance between the midpoint of the semiconductor wafer and the midpoint of the carrier (=eccentricity of the semiconductor wafer in the carrier)
ϕ (Polar) angle of the reference point on the semiconductor wafer
H Local thickness of the semiconductor wafer
l(e) Length of the circle arc segment of the circle arc about the midpoint of the carrier and through the reference point of the semiconductor wafer which runs within the area of a semiconductor wafer
NCL Normalized cumulated length of the machining traces (per angle class)
$n_o$ Rotational speed of the upper working disk
$n_u$ Rotational speed of the lower working disk
$n_i$ Rotational speed of the inner rolling apparatus
$n_\alpha$ Rotational speed of the outer rolling apparatus
$r_i$ Pitch radius of the inner rolling apparatus
$r_a$ Pitch radius of the outer rolling apparatus
r Radial distance between the reference point on the semiconductor wafer and the midpoint of the rolling apparatus
$\mathcal{R}$ Decrease in the thickness of the working layer on account of wear
R Radius of the semiconductor wafer
RR Radial position on working disk
ρ Radial position on semiconductor wafer
s Arc length of the trajectory of the reference point of the semiconductor wafer
σ Angular velocity of the circulation of the midpoints of the carriers about the midpoint of the rolling apparatus ("midpoint rotational velocity")
$\sigma_o$ Midpoint rotational velocity with respect to the upper working disk
$\sigma_u$ Midpoint rotational velocity with respect to the lower working disk
ω Angular velocity of the inherent rotation of the carriers about their respective midpoints ("inherent rotational velocity")
$\omega_o$ Inherent rotational velocity with respect to the upper working disk $\omega_u$ Inherent rotational velocity with respect to the lower working disk

DETAILED DESCRIPTION OF THE PREFERRED EMBODIMENT(S)

The object(s) are achieved by means of a first method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein the temperature prevailing in the working gap is kept constant during the machining.

The object(s) are likewise achieved by means of a second method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein per unit time the magnitude of the number of revolutions of the carriers about the midpoint of the rolling apparatus and relative to each of the two working disks is greater than the magnitude of the number of revolutions of the individual carriers about their respective midpoints.

The object(s) are likewise achieved by means of a third method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein the magnitude of the ratio of the difference in the magnitudes of the theoretical wear $\mathcal{R}(r)$ of the two working layers to the mean value of the magnitudes of the wear of the two working layers for each radial position r is less than 1/1000, where the magnitude of the theoretical wear of each working layer is given by $$\mathfrak{R}_i(r) = \left| \int_{e_{min}}^{e_{max}} \frac{\sqrt{a^2\sigma_i^2 + e^2\omega_i^2 + (r^2 - a^2 - e^2)\sigma_i\omega_i}}{\frac{\sigma_i - \omega_i}{2}\sqrt{2(a^2r^2 + e^2r^2 + a^2e^2) - r^4 - a^4 - e^4}} \cdot l(e) \cdot de \right|,$$

$$\left(\frac{\sigma_i - \omega_i}{2} \cdot \frac{a^2 - e^2}{r2} + \frac{\sigma_i + \omega_i}{2}\right)$$

where $\alpha$ indicates the pitch radius of the circulating movement of the carriers on the working disks about the midpoint of the rolling apparatus; e indicates the distance between the currently considered reference point and the midpoint of the corresponding carrier; l(e) indicates the arc length—running within the area of the semiconductor wafer—of the circle with radius e about the midpoint of the corresponding carrier; r indicates the radial position with respect to the midpoint of the working disks; $\sigma_i$ indicates the angular velocity of the circulation of the carriers about the midpoint of the working disks; $\omega_i$ indicates the angular velocity of the inherent rotation of the carriers about their respective midpoints, $e_{min}=\max\{0; e_{ecc}-R\}$ and $e_{max}=e_{ecc}+R$ where R=radius of the semiconductor wafer denote the lower and upper limits of the integration over e; $e_{ecc}$ indicates the eccentricity of the semiconductor wafer in the carrier and the index i=o for the upper working disk or i=u for the lower working disk indicates whether the angular velocities $\sigma_i$ and $\omega_i$ relate to the upper or the lower working disk.

The object(s) are also achieved by means of a fourth method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein for each working layer the magnitude of the theoretical wear $\mathcal{R}(r)$ for each radial position r deviates by less than 30% from the theoretical wear averaged over the entire working layer, where the magnitude of the theoretical wear of each working layer is given by $$\mathfrak{R}_i(r) = \left| \int_{e_{min}}^{e_{max}} \frac{\sqrt{a^2\sigma_i^2 + e^2\omega_i^2 + (r^2 - a^2 - e^2)\sigma_i\omega_i}}{\frac{\sigma_i - \omega_i}{2}\sqrt{2(a^2r^2 + e^2r^2 + a^2e^2) - r^4 - a^4 - e^4}} \cdot l(e) \cdot de \right|,$$

$$\left(\frac{\sigma_i - \omega_i}{2} \cdot \frac{a^2 - e^2}{r2} + \frac{\sigma_i + \omega_i}{2}\right)$$

where the symbols have the meaning indicated for the third method.

Finally, the object(s) are also achieved by means of a fifth method for the simultaneous double-side grinding of a plurality of semiconductor wafers, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein the proportion of the total material removal that is made up by the material removal brought about by the abrasive released in the course of the wear of the working layers is always less than the proportion made up by the material removal brought about by the abrasive fixedly bonded in the working layer.

By means of the abovementioned methods and, in particular, an expedient combination of said methods, it is possible to produce semiconductor wafers having significantly improved properties.

Therefore, the invention also relates to a semiconductor wafer, featuring

- an isotropic ground pattern, wherein regions with grinding marks that run parallel or symmetrically with respect to a point or an axis of symmetry relative to one another make up less than 10% of the entire surface of the semiconductor wafer,
- a thickness variation of less than 1 μm on the entire semiconductor wafer minus an edge exclusion of 1 mm,
- a thickness variation of less than 0.7 μm allotted to a region that lies at the edge of the semiconductor wafer and has a width of 1/10 of the diameter of the semiconductor wafer, a thickness variation of less than 0.3 μm allotted to a region that lies in the center of the semiconductor wafer and has a diameter of ⅕ of the diameter of the semiconductor wafer, a warp and a bow of in each case less than 15 μm, an RMS roughness of less than 70 nm in the correlation length range of 1 μm to 80 μm, and a depth of the crystal damage near the surface of less than 10 μm.

Figure 1:
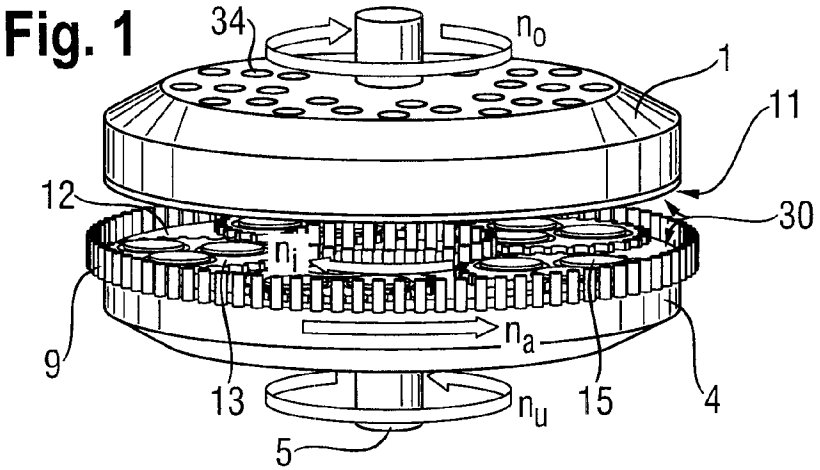
FIG. 1 shows one embodiment of an apparatus suitable for carrying out the method according to the invention.

FIG. 1 shows the essential elements of an apparatus according to the prior art that is suitable for carrying out the methods according to the invention. The illustration shows the basic schematic diagram of a two-disk machine for machining disk-shaped workpieces such as semiconductor wafers, such as is disclosed for example in DE 10007390 A1, in perspective view. An apparatus of this type has an upper working disk 1 and a lower working disk 4 with collinear rotational axles 5 and with substantially plane-parallel arrangement of the working surfaces of the working disks with respect to one another. According to the prior art, the working disks 1 and 4 are fabricated from gray cast iron, cast stainless steel, ceramic, composite materials or the like. The working surfaces are uncoated or provided with a coating made of, for example, stainless steel or ceramic, etc. The upper working disk contains numerous holes 34 through which operating agents can be fed to the working gap 30. This is a cooling lubricant (e.g. water) for the application of such an apparatus as a grinding machine. The apparatus is provided with a rolling apparatus for carriers 13. The rolling apparatus comprises an inner drive ring 7 and outer drive ring 9. The carriers 13 each have at least one cutout which can receive a semiconductor wafer 15 to be machined. The rolling apparatus may be embodied for example as pin gearing, as involute gearing or as some other customary type of gearing. For reasons of maintenance convenience, production costs and owing to generally large machine dimensions and the unavoidable play of the gear mechanisms that is associated therewith, pin gearing, which is noncritical in this regard, is preferred. Upper working disk 1 and lower working disk 4 and inner drive ring 7 and outer drive ring 9 are driven at rotational speeds $n_o$, $n_u$, $n_i$ and $n_\alpha$ about essentially identical axes 5.

In the case where the apparatus is used for a method according to the invention, each working disk 1, 4 carries on its working surface a working layer 11, 12 preferably comprising cloths (woven, knitted, felted; fiberwoven fabrics, plastic matrices with or without fiber inlay), films (monolayer or multilayer) or foams in whose upper layers that come into material-removing contact with the semiconductor wafers abrasive substances are incorporated as abrasive.

An example of a film suitable for carrying out the methods according to the invention is disclosed in U.S. Pat. No. 6,007,407. Examples of cloths are disclosed for example in WO 99/24218 and U.S. Pat. No. 5,863,306. Examples of such films or cloths with a structured (textured, "micro-replicated") working surface are specified in U.S. Pat. No. 6,599,177 B2.

The working layers are preferably adhesively bonded onto the working disks. In accordance with the prior art, such cloths, films or layers are provided with a self-adhesive coating on the rear side and are fixed on the working disks by adhesive bonding. Particularly in the case of apparatuses having large dimensions, the fault-free application of such working layers onto the working disks without faults such as included air bubbles, compression, stretching or bulging of the working layer and also the removal of the working layer after use are difficult. Thus, JP 2001-219362A specifies an embodiment of such a working layer equipped with pores (channels) through which air bubbles included between working disk surface and cloth rear side can escape, thus resulting in a planar, uniform cloth support. Furthermore, WO 95/19242 proposes equipping the cloth rear side with small hooks and a complementary equipped working surface of the working disks ("hook and loop fastener"), which enable the working layers to be changed particularly rapidly and in a manner free of residues. The cloths, films, foams or layers often cannot be produced in one piece. They are then laminated or assembled piece by piece onto large carrier substrates (film, cloth, foam, etc.). This is disclosed for example in U.S. Pat. No. 6,179,950 B1.

In order to carry out the method according to the invention, the fixing of the working layers for example by suction by vacuum (through an air-permeable layer of the working disk composed of porous material, for example ceramic), by magnetic or electrostatic fixing or by covering by means of tensioning devices fitted on the working disk, etc. is furthermore suitable.

The working gap formed between the working layers 11 and 12 fixed on the upper working disk 1 and lower working disk 4, within which gap the semiconductor wafers are machined, is designated by 30 in FIG. 1.

Figure 2:
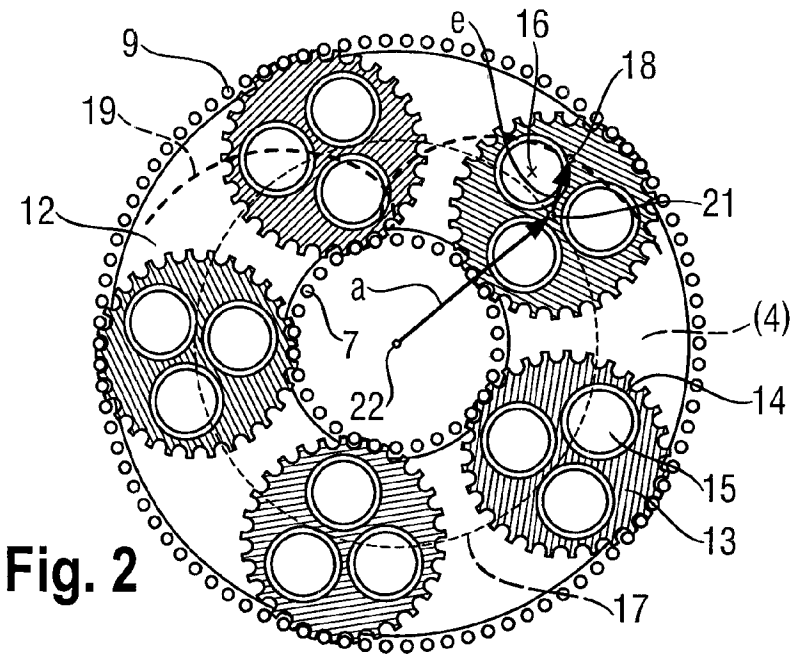
FIG. 2 shows the lower working disk of the apparatus illustrated in FIG. 1 with the rolling apparatus, the carriers and the semiconductor wafers to be machined, in plan view.

FIG. 2 shows the apparatus in a plan view of the lower working disk 4. The semiconductor wafers 15 are inserted into carriers 13, which are also referred to as guide cages. The semiconductor wafers are not fixedly connected by positively or force locking fitting with the respective cutout of the carrier, with the result that they can move freely within the cutouts. In the preferred case of round semiconductor wafers, in particular an inherent rotation of the semiconductor wafers in the cutouts of the carriers is possible. Said inherent rotation is desirable since the semiconductor wafers then assume a rotationally symmetrical form, which increases their flatness and symmetry and is therefore advantageous for the purposes of the invention.

Hereinafter the midpoint of the working disks and rolling apparatus, that is to say of the entire apparatus, shall also be designated by 22. The midpoint of a semiconductor wafer 15 in a carrier 13 shall be designated by 16, and the midpoint of the carrier shall be designated by 21. An arbitrary reference point 18 describes a trajectory 19 on the lower working layer 12 of the lower working disk 4 on account of the rotation of the working disk and the rotation of the drive rings 7 and 9. The midpoints 21 of the carriers 13 circulate on a pitch circle 17 that is concentric with respect to the midpoint 22 of the rolling apparatus.

FIG. 3 defines further characteristic variables for describing the movement of the semiconductor wafer in the grinding machine. In this case, the reference system is chosen such that the working disk considered is at rest in it (concomitantly rotating reference system). Only the lower working disk 4 is depicted in the plan view in FIG. 3. s shall designate the arc length of the trajectory 19 of the reference point 18 of the semiconductor wafer 15 in a carrier 13 over the working layer 12. The position of said reference point 18 is described at any time by a radial distance r from the midpoint 22 of the rolling apparatus and an angle $\phi$ (plane polar coordinates). Owing to the rotations $n_i$ and $n_\alpha$ of the inner drive ring 7 and outer drive ring 9 and the rotation of the working disk, the carrier 13 rotates at angular velocity $\omega$ about its midpoint 21, and said midpoint 21 circulates at angular velocity $\sigma$ about the midpoint 22 of the entire apparatus. The distance between the midpoint 21 of the carrier and the midpoint 16 of the semiconductor wafer 15 is designated as the eccentricity $e_{ecc}$ of the semiconductor wafer in the carrier. e shall designate the distance between the reference point 18 on the semiconductor wafer 15 and the midpoint 21 of the carrier 13. R is the radius of the semiconductor wafer 15. l(e) is the length of the circle arc with radius e about the midpoint 21 of the carrier 13 which runs within the area of the semiconductor wafer 15.

In accordance with the first method of the invention, the temperature in the working gap is kept constant, to be precise preferably during the entire duration of the simultaneous double-side grinding. According to the invention, during the grinding, the temperature in the working gap is measured and corrected by means of suitable measures if the measured temperature deviates from the desired temperature. The temperature can be measured for example at defined intervals or continuously. By virtue of the constant temperature in the working gap, a deformation of the working disks that is brought about by temperature change is avoided and the working disks are kept in a constant, plane-parallel form. This results in a significantly improved geometry of the machined semiconductor wafers, thereby enabling the production of a semiconductor wafer according to the invention.

In one embodiment of this first method, each working disk has at least one cooling labyrinth through which a coolant flows. In this embodiment, the temperature or the flow rate of the coolant is varied in a suitable manner in order to counteract an undesirable temperature change and to achieve a constant temperature in the working gap. A suitable and preferred arrangement of cooling labyrinths is disclosed in DE 19954355 A1. This arrangement features an upper layer ("upper plate") pervaded by a cooling labyrinth, a thermally insulating interlayer and a lower layer ("lower plate") pervaded by a second cooling labyrinth. Furthermore, a method for setting and regulating the planarity of a polishing plate for lapping, grinding or polishing of substrate wafers is disclosed therein, wherein the lower plate of an at least three-layered polishing plate is temperature-regulated and then the temperature is kept constant and the upper plate of the entire working disk is temperature-regulated and the temperature is adapted to the respective polishing process in such a way that steady-state thermal conditions are created in the polishing apparatus as a result of the temperature regulation of the lower plate. A corresponding application is also possible in the grinding method according to the invention.

It is particularly preferred, however, to keep the temperature in the working gap constant by varying the temperature or the flow rate of the cooling lubricant fed to the working gap according to the measured temperature. It is also possible to vary both parameters, temperature and flow rate, in a suitable manner in order to keep the temperature in the working gap constant. This type of regulation has the advantage over temperature regulation by means of the cooling labyrinths that it is significantly less sluggish.

If a temperature lying above the defined desired value is measured, then the temperature of the coolant or of the cooling lubricant is lowered in a control loop. By contrast, if the temperature lying below the defined desired value is measured, then the temperature of the coolant or of the cooling lubricant is increased, such that the temperature in the working gap remains substantially constant.

The temperature in the working gap is measured for example directly by means of temperature sensors incorporated into the surface of the working disks through the (thin) working layer or through small "measuring windows" cut out in the working layer. Since the working disks rotate during grinding, the measured temperature value is transmitted either by contact, for example by means of electrical sliding-action contacts, or contactlessly, for example via radio, infrared or inductively. As an alternative, the temperature in the working gap can also be measured indirectly by means of a measurement of the temperature of the cooling lubricant discharging from the working gap.

The second method according to the invention is described in more detail below: in this method, the working disks rotate about the center of the entire apparatus at higher angular velocity than the carriers rotate about their respective midpoints. To put it more precisely, this means that the magnitudes of the angular velocities $\Omega_i$ of upper, $\Omega_o$, and lower, $\Omega_u$, working disk are greater than the magnitude of the difference between the angular velocity $\omega_0$ of the inherent rotation of the carriers about their respective midpoints and the angular velocity $\sigma_0$ of the circulation of the carriers about the midpoint of the entire rolling apparatus, $|\Omega_i| \geqq |\omega_0 - \sigma_0|$. The spread of the velocity distribution is thereby reduced. The relative velocities between the semiconductor wafers and the working layers of the working disks are not constant, but rather dependent on location and time, due to the dictates of the method. The velocity distribution should be understood to mean the frequency of the occurrence of specific relative velocities. A velocity distribution with a small spread is advantageous since it results in an isotropic machining of the semiconductor wafers, thereby enabling the production of a semiconductor wafer according to the invention.

In the context of the second method according to the invention, the trajectories of the semiconductor wafers relative to each of the two working disks are preferably in each case epitrochoids, i.e. regular, lengthened or shortened epicycloids.

Furthermore, in the context of the second method according to the invention, it is preferred for the lengths of the trajectories which the semiconductor wafers cover in identical times relative to the two working disks to be approximately identical. This requirement is regarded as fulfilled particularly when the magnitude of the ratio of the difference in the lengths of the trajectories which the semiconductor wafers cover relative to the two working disks in identical times, and the mean value of the lengths of said trajectories is less than 20%. However, there are also kinematics which entail a completely identical length of the trajectories, but this is not absolutely necessary. Approximately identical lengths of the trajectories can be achieved by choosing the rotational speed of the carriers to be relatively low in comparison with the rotational speed of the working disks.

The abovementioned measures mean that the front and rear sides of the semiconductor wafers experience at every point in time identical friction forces, starting directions of the working layers, velocities and accelerations. In particular, abrupt load changes are avoided and a uniform inherent rotation of the semiconductor wafers in the holes in the carriers is supported. The velocity profiles are similar for the front and rear sides with regard to spread and time distribution. This results in an approximately symmetrical material removal from the front and rear sides and an isotropic ground pattern with little warp/bow of the semiconductor wafer induced by location-dependent or front-/rear-side-asymmetrical roughness or crystal damage near the surface (strain-induced warp/bow). As a result, the surface of the semiconductor wafer becomes planar and isotropic without warpages and deformations such as are known for example as "grinding navel" (center depression) or "edge roll-off" (thickness decrease in the edge region) of grinding, lapping or polishing methods in accordance with the prior art. In addition, an advantage is that the edge profile that was generally produced before carrying out the simultaneous double-side grinding is not changed asymmetrically and the symmetry of the edge profile is thereby maintained.

The third and fourth methods according to the invention are described in detail below:

since a working layer having self-dressing properties is required for carrying out the method according to the invention, the working layer must be subjected to a certain finite wear in order to continuously uncover new, sharp abrasive substances that lead to a uniform grinding characteristic. On the other hand, excessively high wear of the working layer from grinding to grinding is not desirable since the thickness and form of the working layer would then change too rapidly and continuous tracking of the machining parameters (machine and process parameters) would be necessary, which would lead to a process that is disadvantageous by account of its being unstable. There is therefore an optimum wear rate which just still guarantees self-dressing properties, but on the other hand does not lead to a working layer that is all too unstable geometrically, with the result that a largely stable machining process is possible which reproducibly yields semiconductor wafers having flatness properties that are constant over wide ranges.

In order to be able to predict the wear of the working layer, its loading by the semiconductor wafers machined by it must be determined in spatially resolved fashion. This requires a precise description of the trajectories which the semiconductor wafers cover during machining over the working disks.

In a reference system that is concomitantly moved with the rotating working disk (invariant reference system), the trajectory (t) of an arbitrary reference point 18 of a semiconductor wafer over a working disk, with the designations defined in FIG. 3, can be written in complex numbers $\bar{z}(t)=x(t)+iy(t)$ as $$\bar{z}(t)=\alpha e^{i\sigma t}+ee^{i\omega t}. \tag{1}$$

With the identity $e^{ix}\equiv\cos x+i\cdot\sin x$, equation (1) immediately yields the temporal parameter representation of the trajectory in real Cartesian coordinates (x(t);y(t)).

The radial $r(t)=|\bar{z}(t)|$position and the $v(t)\equiv\dot{s}(t)$ magnitude of the path velocity $\bar{v}(t)=\dot{\bar{z}}(t)$emerge as a result of magnitude formation and differentiation with respect to time as $$r(t)=\sqrt{a^2+e^2+2ae\cos(\sigma-\omega)t} \tag{2}$$

and $$\dot{s}(t)=\sqrt{a^2\sigma^2+e^2\omega^2+2ae\sigma\omega\cos(\sigma-\omega)t}\,.$$

In this case, s(t) denotes the arc length covered and a dot above a variable denotes the derivative thereof with respect to time.

The angle $\phi(t)$ of the position of the reference point P in plane polar coordinates (r(t); $\phi(t)$) and the time derivative (t) of the radial position r(t) are finally given by $$\varphi=\arctan\frac{a\sin\sigma t+e\sin\omega t}{a\cos\sigma t+e\cos\omega t} \tag{3}$$

and $$\dot{r}(t)=\frac{-ae(\sigma-\omega)\sin(\sigma-\omega)t}{\sqrt{a^2+e^2+2ae\cos(\sigma-\omega)t}}.$$

r(t) from equation (2) and $\phi(t)$ from equation (3) yield a parameter representation with respect to time in plane polar coordinates.

Taking account of $$\frac{\partial}{\partial x}\arctan x=\frac{1}{1+x^2}$$

the following is obtained:

$$\dot{\varphi}(t)=\frac{a^2\sigma+e^2\omega+ae(\sigma+\omega)\cos(\sigma-\omega)t}{a^2+e^2+2ae\cos(\sigma-\omega)t}. \tag{4}$$

Inserting equation (2) for r(t) into the expressions for $\dot{s}(t)$, $\dot{r}(t)$ and $\dot{\phi}(t)$ yields the corresponding expressions as a function of the radial position r on the working disk $$\dot{s}(r)=\sqrt{a^2\sigma^2\left(1-\frac{\omega}{\sigma}\right)+e^2\omega^2\left(1-\frac{\sigma}{\omega}\right)+r^2\sigma\omega}, \tag{5}$$

$$\dot{\varphi}(r)=\frac{\sigma-\omega}{2}\cdot\frac{a^2-e^2}{r^2}+\frac{\sigma-\omega}{2}$$

and $$\dot{r}(r)=-\frac{\sigma-\omega}{2r}\sqrt{2(a^2e^2+a^2r^2+e^2r^2)-r^4-a^4-e^4}\,.$$

Without further assumptions, the radially dependent wear $\mathcal{R}(r)$ of the working layer that is caused by an arbitrary reference point 18 of a semiconductor wafer 15 that sweeps over the working layer can be described as proportional to the arc length $\partial s$ swept over by reference point 18 per area element $r\cdot\partial r\cdot\partial\phi$ and to the time $\partial t$ required for this:

$$\mathcal{R}(r)\propto\frac{\partial s\cdot\partial t}{r\cdot\partial r\cdot\partial\varphi}=\frac{\dot{s}}{r\dot{r}\dot{\varphi}}. \tag{6}$$

Inserting the expressions found above yields $$\mathcal{R}(r)\propto\frac{\sqrt{a^2\sigma^2+e^2\omega^2+(r^2-a^2-e^2)\sigma\omega}}{-\frac{\sigma-\omega}{2}\sqrt{2(a^2r^2+e^2r^2+a^2e^2)-r^4-a^4-e^4}\left(\frac{\sigma-\omega}{2}\cdot\frac{a^2-e^2}{r2}+\frac{\sigma+\omega}{2}\right)}. \tag{7}$$

Finally, the length l(e) of the circle arc with radius e about the midpoint of the carrier which runs through the semiconductor wafer in the carrier is determined numerically for all e in the permitted range of values for $\mathcal{R}$(r,e). This therefore takes account of the contribution of all equivalent points of the semiconductor wafer with identical distance e about the midpoint of the carrier which, in the course of the inherent rotation of the carrier all at some time sweep over the considered point of the working area in the same way and contribute to the wear of said working area. Integration of the expression obtained over all e finally produces the expression $\mathcal{R}_{ges}$(r) sought for the wear of the working layer by the totality of all possible reference points within the areally extended semiconductor wafer:

$$\mathfrak{R}_{ges}(r) \propto \left| \int_{e_{min}}^{e_{max}} l(e) \cdot \frac{\sqrt{a^2\sigma_i^2 + e^2\omega_i^2 + (r^2 - a^2 - e^2)\sigma_i\omega_i}}{-\frac{\sigma_1 - \omega_1}{2}\sqrt{2(a^2r^2 + e^2r^2 + a^2e^2) - r^4 - a^4 - e^4}} \left(\frac{\sigma_i - \omega_i}{2} \cdot \frac{a^2 - e^2}{r^2} + \frac{\sigma_i + \omega_i}{2}\right) de \right| \quad (8)$$

In this case, the index i=o (upper) or i=u (lower working disk) denotes the individual angular velocities $\sigma_o$, $\sigma_u$, $\omega_o$ and $\omega_u$ with respect to the respective working disk, and $e_{min}=\max\{0; e_{ecc}-R\}$ and $e_{max}=e_{ecc}+R$. Since the semiconductor wafers can be arranged in diverse ways in the carriers, an analytical expression for l(e) which enables a closed solution for the integral in equation (8) will not generally be produced. In practice, therefore, for many values e in the range of values $\{e_{min} \ldots e_{max}\}$, the value of l(e) is calculated and, instead of the integration in equation (8), a summation over the integrands over all e is carried out. Occasionally, l(e) is also referred to as "shape function" that describes the arrangement of the semiconductor wafers in the carriers.

It proved to be advantageous, then, to choose parameter combinations $\sigma_i$ and $\omega_i$ for given values $\alpha$ and $e_{ecc}$ of an apparatus suitable for carrying out the method according to the invention for which the wear of the working layer according to equation (8) varies as little as possible over the entire radius of the working layer, which led to the definition of the fourth method according to the invention. It can thereby be ensured that the working layers are worn homogeneously, which ensures a permanently uniform material removal from the semiconductor wafers. Irregular undulations in the thickness profile of the ground semiconductor wafers can thus be reliably avoided.

What is more, it is also advantageous if the wear of the working layer according to equation (8) is as similar as possible for the upper and lower working layers, which is reflected in the third method according to the invention. This last means in concrete terms that the magnitude of the ratio of the difference in the magnitudes of the theoretical wear $\mathfrak{R}(r)$ of the two working layers to the mean value of the magnitudes of the wear of the two working layers for each radial position r of the working disks amounts to less than 1/1000. In this connection, it is also preferred for the change in the thickness homogeneity of the working layer on account of wear to amount to less than a hundredth of the magnitude of the thickness decrease of the semiconductor wafers during the grinding machining, the thickness homogeneity of the working layer being defined as the difference between largest and smallest thickness over the entire area of the working layer that comes into contact with the semiconductor wafers.

A parameter set for the operation of the grinding apparatus which simultaneously meets the requirements of the third and fourth methods according to the invention will preferably be chosen.

Suitable machine-independent parameter sets $\{\sigma_o, \sigma_u, \omega_o, \omega_u\}$ which meet the condition for $R_i(r)$ are obtained from the known equations for planetary gear mechanisms:

$$\begin{pmatrix} \sigma_o \\ \sigma_u \\ \omega_i \\ \omega_a \end{pmatrix} = 2\pi \begin{pmatrix} \frac{r_i}{r_a - r_i} & \frac{r_a}{r_a - r_i} & -1 & 0 \\ \frac{r_i}{r_a - r_i} & \frac{r_a}{r_a - r_i} & 0 & -1 \\ \frac{r_i}{r_a + r_i} & \frac{r_a}{r_a + r_i} & -1 & 0 \\ \frac{r_i}{r_a + r_i} & \frac{r_a}{r_a + r_i} & 0 & -1 \end{pmatrix} \begin{pmatrix} n_o \\ n_u \\ n_i \\ n_a \end{pmatrix} \quad (9)$$

from the machine-dependent parameter sets $\{n_o, n_u, n_i, n_a\}$ for the drive rotational speeds $n_j$ (j=o, rotational speed of upper working disk; j=u, lower working disk), $n_i$=rotational speed of the inner drive ring and $n_\alpha$=rotational speed of the outer drive ring and checking by insertion in the formula for $\mathfrak{R}_i(r)$, where $r_i$ is the pitch radius of the inner and $r_a$ that of the outer drive ring for the carriers. On account of the few independent degrees of freedom of the system, this rapidly yields suitable parameter sets that meet the condition.

FIG. 8(A) shows an unfavorable parameter combination $\{\sigma_i;\omega_i\}$ which does not have these properties, and FIG. 8(B) shows a favorable parameter combination which does have these properties. The conversion of the machine-dependent kinematic parameters $\{n_o, n_u, n_i, n_a\}$ into machine-independent kinematic parameters $\{\sigma_o, \sigma_u, \omega_i, \omega_a\}$ is explained in greater detail for example in: Th. Ardelt, Berichte aus dem Produktionstechnischen Zentrum Berlin, Fraunhofer-Institut für Produktionsanlagen und Konstruktionstechnik, IPK Berlin, 2001, ISBN 3-8167-5609-3.

For the apparatus that is disclosed in DE 10007390 A1 and is suitable for carrying out the method according to the invention and has pitch radii $r_i$ and $r_a$ of the rolling apparatus for the carriers with characteristic figures $r_i/(r_a-r_i)\approx 0.552$, $r_i/(r_a+r_i)\approx 0.262$ the conversion of the machine-dependent parameter set $(n_o, n_u, n_i, n_\alpha)$=(30, −36, −46, 12) RPM produces the machine-independent parameter set $(\sigma_o, \sigma_u, \omega_o, \omega_u)$=(−33.2, 32.8, 14.0, 80.0) 1/s.

Figure 10A:
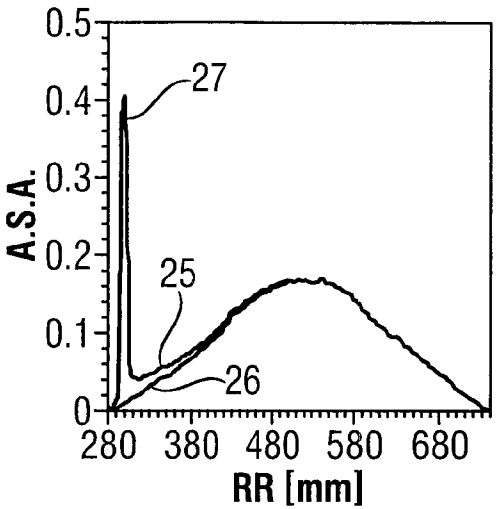
FIG. 10 illustrates the radial wear profiles of the upper 25 and lower 26 working layers that are calculated from the parameter sets from FIG. 8. (A): for a method not carried out according to the invention; (B): a method according to the invention comprising the features of the second, third and fourth embodiments.
Figure 11A:
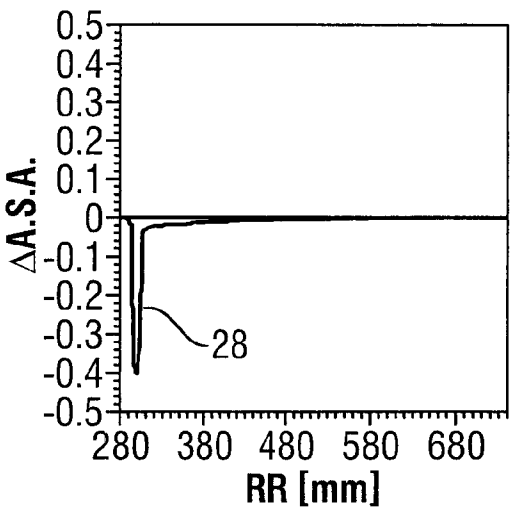
FIG. 11 illustrates the differences in the radial wear profiles of upper and lower working layers that are calculated from the parameter sets from FIG. 8. (A): for a method not carried out according to the invention; (B): a method according to the invention comprising the features of the second, third and fourth embodiments.
Figure 10B:
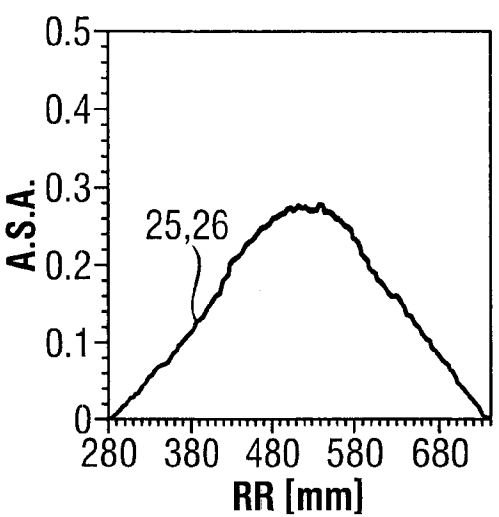
Figure 11B:
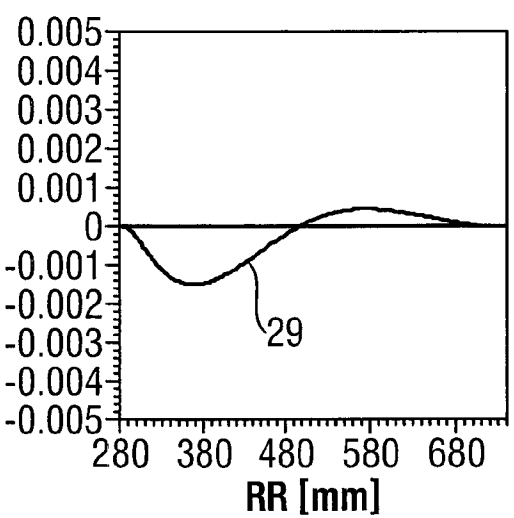

The trajectories 19 produced on the upper working layer 11 are shown in the left-hand half of FIG. 9. The trajectories 20 produced on the lower working layer 12 are shown in the right-hand half of FIG. 9. The working layers have an extremely inhomogeneous wear according to equation (8) (FIG. 10 (A)) for the parameter combination according to FIG. 8 (A). For the lower working layer, there arises close to its inner edge a sharply delimited region 27 with extremely high local wear and a wider region 25 with somewhat increased wear relative to the wear 26 of the upper working layer. The difference in the two wears of the working layers calculated for these chosen method parameters is shown in FIG. 11 (A) (28).

In contrast thereto, FIG. 8 (B) shows a choice of method parameters according to the invention. The wear of the upper and lower working layers (25 and 26) that is obtained is symmetrical over the radius of the working disk of the apparatus and virtually identical for the upper and lower working layers (FIG. 10 (B)). The difference 29 in the wears of the two working layers is over 100 times smaller than in the case of the example with a choice of parameters that is not according to the invention, as specified in FIG. 8 (A).

The third and fourth methods according to the invention permit the production of the semiconductor wafer according to the invention, the best results being obtained if the requirements of both methods are met simultaneously.

Description of the Fifth Method According to the Invention

The fifth method according to the invention is described below: in this method, the proportion of the total material removal that is made up by the material removal brought about by the abrasive released in the course of the wear of the working layers is always less than the proportion made up by the material removal brought about by the abrasive fixedly bonded in the working layer.

Alongside a suitable choice of the average applied load of the upper working disk, this is achieved in particular and preferably by means of a uniform loading of the working layer over the entire trajectory. For this purpose, it is preferred to keep the temperature in the working gap constant in accordance with the first method according to the invention in order to avoid a deformation of the working disks that is caused by temperature changes. As a result, a working gap that is parallel over the entire process and at every point arises between the working layers of the upper and lower working disks, and the working layers are loaded with constant force by the semiconductor wafers that are led across them during the machining. A structural collapse of the grain bonding of the working layers with premature release of unused abrasive grain ("parasitic lapping") on account of overload is thus avoided in the same way as the likewise undesirable stopping of a uniform material removal from the semiconductor wafers on account of underload ("incision threshold force").

The third and fourth methods according to the invention are also suitable for achieving a uniform loading and, as a result, a homogeneous wear of the working layers. The bonding of the abrasive substances contained in the working layers is locally overloaded by the nonuniform machining forces in the case of non-uniformly worn working layers. The cloths then wear out particularly rapidly locally and release unused abrasive excessively. The so-called "parasitic lapping" occurs, that is to say a material removal predominantly by free grain as in the case of lapping with lapping slurry. This can be avoided by ensuring a uniform wear of the working layers, which leads to semiconductor wafers having significantly less roughness, a smaller damage depth and a reduced edge roll-off.

Furthermore, this requirement can also be achieved by means of a homogeneous velocity distribution which exhibits little spread and which is in turn preferably achieved by means of the second method according to the invention. This is because, on account of, for example, a finite incision threshold force and on account of cooling lubricant and grinding slurry transport phenomena, during grinding, the material removal rate generally does not necessarily vary proportionally to pressure and speed of the grinding movement. Therefore, an inhomogeneous or spread velocity distribution would generally load the working layer nonuniformly and lead to a nonuniform material removal and hence an undesirable resulting form of the semiconductor wafer.

It is furthermore preferred to choose a sufficient flow rate of the cooling lubricant which avoids an excessive wear of the working layers. Too little cooling lubricant leads to local heating of the working layer and thus overloading of abrasive grain (loss of cutting capability), grain bonding or, on account of thermal expansion and pressure increase, nonuniform wear. Too much cooling lubricant leads to partial floating of the semiconductor wafers ("aquaplaning") and therefore likewise to an impairment of the uniformity of the material removal.

In particular, it is also preferred for the thickness decrease of the working layer on account of wear during a grinding operation to amount to less than 10%, more preferably less than 2%, of the thickness decrease of the semiconductor wafers during the grinding operation.

Each of the five methods according to the invention contributes to producing a semiconductor wafer according to the invention. Particularly advantageous and in particular inventive properties of the semiconductor wafer arise, however, if the requirements of a plurality or ideally all of the methods according to the invention are met simultaneously.

Preferred Embodiments

Preferred embodiments that are valid for all of the methods according to the invention are described below:

a hard material having a Mohs hardness≧6 is preferred as abrasive bonded in the working layers. Possible abrasive substances that are known in the prior art are diamond, silicon carbide (SiC), cerium dioxide ($CeO_2$), corundum (aluminum oxide, $A1_2O_3$), zirconium dioxide ($ZrO_2$), boron nitride (BN; cubic boron nitride, CBN), furthermore silicon dioxide ($SiO_2$), boron carbide ($B_4C$) through to significantly softer substances such as barium carbonate ($BaCO_3$), calcium carbonate ($CaCO_3$) or magnesium carbonate ($MgCO_3$). However, diamond, silicon carbide (SiC) and aluminum oxide ($Al_2O_3$; corundum) are particularly preferred.

The average grain size of the abrasive should be less than 9 μm. In the case of diamond as abrasive, the preferred size of the abrasive grains bonded in the working layers is on average 0.1 to 9 μm, and most preferably 0.1 to 6 μm. The diamonds are preferably bonded individually or as clusters in the bonding matrix of the working layer. In the case of cluster bonding, the grain diameters specified as preferred relate to the primary particle size of the cluster constituents.

Working layers with ceramic bonding are preferably used; a synthetic resin bonding is particularly preferred; in the case of working layers with clusters also a hybrid-bonded system (ceramic bonding within the clusters and synthetic resin bonding between clusters and working layer matrix).

The hardness of the working layer is preferably at least 80 Shore A. Particularly preferably, the working layer is constructed in multilayer fashion, the upper and lower layers having different hardnesses, with the result that point elasticity and long-wave compliance of the working layer can be adapted to the method requirements independently of one another.

Prior to the first use of a working layer, the abrasive substances bonded into the working layer are preferably uncovered by removing the topmost layer in order to make them usable for the grinding operation. This initial dressing is carried out for example with the aid of grindstones or blades that are preferably mounted on specially modified carriers and, in a manner similar to that in the method according to the invention, are themselves led over the two working disks by means of the rolling apparatus.

The dressing is preferably effected using grindstones containing abrasive grain having a similar grain size to the abrasive in the working layers. These "dressing blocks" may be annular, for example, and inserted into an externally toothed driver ring, such that they can be guided along between the upper and lower working layers in a suitable manner by means of the rolling apparatuses of the grinding machine. During trimming, the dressing blocks preferably sweep over the entire area of the working layers and most preferably even temporally or else continuously run somewhat beyond the edge of said layers. Preferably, the abrasive grain is bonded in the dressing block in such a way that the wearing of the dressing blocks still permits an economic dressing operation, but during the dressing process at least one layer of loose dressing block grain is always situated in the working zone between dressing block and working layer surface, with the result that the dressing is predominantly effected by free (unbonded) grain.

This is because it has been shown that the dressing process produces a disturbed layer near the surface in the working layer, the depth of which has approximately the extent of the dressing grain. Therefore, a dressing block with excessively coarse grain impresses on the working layer a structure that is characterized by the grain of the dressing block and not by the properties of the working layer. This is disadvantageous for the desired process of self-dressing the working layer as uniformly as possible in the subsequent grinding operation. An excessively fine dressing block yields too little material removal and leads to an uneconomic dressing operation. Finally, it has been shown that dressing predominantly by means of free dressing grain, on account of the rolling movement of the dressing grain during the dressing movement, exerts less directed forces on the working layer than dressing by means of predominantly fixed dressing grain and the result is a dressed working layer which, although rougher, is particularly isotropic.

Preferably, a grain that is softer than the abrasive grain used in the working layer is used for dressing or trimming the working layer. The dressing grain is most preferably made of corundum ($Al_2O_3$).

In operation, given a suitable choice of working layer and machine parameters, abrasive substance residues that have become blunt through continuous wear of the working layer are removed and new abrasive substances with a high capacity for cutting are continuously uncovered. Continuous operation up to the complete wear of the working layers is thereby possible. This operating condition without intervening subsequent dressing intervention is referred to as "self-dressing working" of the working layers and is particularly preferred. The engaging of the grains exposed at the surface of the working layers into the surface of the semiconductor wafers and the material removal effected by the relative movement of working layer and semiconductor wafers are technically referred to as "multigrain grinding with a geometrically indeterminate cutting edge".

The grinding is preferably conducted in such a way that the speeds chosen for the drives of the grinding apparatus lead to semiconductor wafers that are as planar as possible. On account of the kinematic coupling of tool movement and workpiece movement ("planetary gear mechanism"), the movement of the working disks can then no longer be chosen independently. In particular, movement sequences can occur in which the wear of the working layers no longer takes place completely homogeneously over their entire area. Therefore, the working layers slowly lose their initial form, and, under certain circumstances, an occasionally intervening trimming of the working layers in order to reestablish a plane-parallel working gap is essential. Preferably, the working layer is chosen so as to achieve self-dressing operation with the least possible wear, and the drives are set such that the working layer is loaded as uniformly as possible in conjunction with the semiconductor wafer still having the best possible form, with the result that such intervening trimming operations have to be effected as infrequently as possible. For a desired TTV of the semiconductor wafer of less than 1 μm, operation is still deemed to be economic if trimming has to be effected at most after every 20th run; for a TTV of less than 2, it is still deemed to be economic if trimming has to be effected at most after every 50th run.

It is furthermore preferred for the material removal to be effected by predominantly areal engagement of the working layer. "Areal engagement" should be understood to mean that that part of the area of the working layer which is actually in contact with the semiconductor wafer on average during the grinding machining is significantly larger than the contact area of the grinding coating of a cup grinding disk in the case of machining by means of a conventional cup grinding disk grinding process, for example DDG or SSG. (In the case of DDG, the contact area of the grinding coating of the cup grinding disk in engagement makes up about 0.5% to 3% of the area of the semiconductor wafer; in the case of SSG, it is about 0.5% to 5%.) In the case of the method according to the invention, the proportion is preferably greater than 5%, and most preferably 10% to 80%.

It is also preferred for those parts of the carriers which come into contact with the working layers to contain no metal. The carriers are preferably produced from a completely metal-free material, for example a ceramic material. However, carriers having a core made of, for example, steel or stainless steel which are coated with a non-metallic coating are also preferred. Such a coating preferably comprises thermoplastics, ceramic or organic-inorganic hybrid polymers such as, for example, Ormocer® (a silicate compound), diamond ("diamond-like carbon", DLC), but as an alternative also a hard chromium plating or nickel-phosphorus coating.

In the case of carriers made of metal or having a metal core, the walls of the cutouts for receiving the semiconductor wafers are preferably lined with a ceramic material, such that no direct contact arises between the semiconductor wafer and the metal of the carrier.

Preferably, the cutouts for receiving the semiconductor wafers in the carriers are provided eccentrically with respect to the center of the respective carrier in such a way that the midpoint of the carriers lies outside the area of the semiconductor wafers. By way of example, in the case of the machining of semiconductor wafers having a diameter of 300 mm, this is an eccentricity of more than 150 mm relative to the center of the carrier. A carrier preferably has three to eight cutouts for semiconductor wafers. During a grinding operation, preferably five to nine carriers are simultaneously situated in the grinding machine.

For the magnitude $\dot{s}(t)=v(t)=|\bar{v}(t)|$ of the path velocity $\bar{v}(t)=\dot{\bar{z}}(t)$, at which arbitrary reference points 18 of the semiconductor wafers 15 move over the working disks 1 and 4, a range of 0.02 to 100 m/s is preferred and a range of 0.02 to 10 m/s is particularly preferred. On account of the restrictions which, by way of example, the suitable apparatus described in DE 10007390 A1 has with regard to the rotational speeds of the main drives that can be realized, and which are typical of apparatuses that are available according to the prior art and are suitable for carrying out the method according to the invention, a range of 0.2 to 6 m/s is particularly preferred for the path velocity.

The pressure with which the working layers are pressed against the semiconductor wafers during machining, and the path velocity of the semiconductor wafers over the working layers are preferably chosen during the main load step such that the total removal rate, i.e. the sum of the removal rates on both sides of the semiconductor wafers, amounts to 2 to 60 μm/min. Main load step should be understood to mean the machining phase within which the greatest proportion of the total removal in the entire grinding treatment is brought about, in which case machining phase should in turn be understood to mean a time segment during which all the method parameters remain constant. Generally, the main load step is the machining phase with the highest pressure or the proportionally longest duration or both. In the case of a working layer with abrasive grains made of diamond having an average size of 3 to 15 μm, a removal rate of between 2.5 and 25 μm/min is particularly preferred.

For the pressure which the working disks exert on the semiconductor wafers during the main load step, a range of 0.007 to 0.5 bar is preferred and a range of 0.012 to 0.3 bar is particularly preferred. For this specification, the pressure is related to the total area of the semiconductor wafers situated for machining in the apparatus, and not to the effective contact area between working layer and semiconductor wafers.

Furthermore, it is preferred for the working disks to rotate in an opposite sense with regard to the average circulating speed of the carriers during the main load step of machining. In addition, it is particularly preferred for the pressures, rotational speeds and hence path velocities to assume different values for the various machining phases. Finally, it is also particularly preferred for the working disks to rotate in the same sense in specific low-pressure machining phases ("spark out" phases). Such a spark-out phase is expedient, and therefore preferred, particularly right at the end of the entire grinding treatment.

The cooling lubricant used in the context of the methods according to the invention preferably comprises a water-based mixture of one or more of the substances mentioned below: viscosity-modifying additives, in particular viscosity-increasing additives such as, for example, glycols, e.g. short- or longer-chain polyethylene glycols, alcohols, sols or gels (e.g. additions of highly disperse silica) and similar substances which are known as coolants or lubricants. pH-modifying additives such as acids, alkaline solutions and composite buffer solutions are furthermore preferred. Alkaline additives such as potassium hydroxide (KOH), potassium carbonate ($K_2CO_3$), tetramethylammonium hydroxide ($N(CH_3)_4OH$), tetramethylammonium carbonate ($N(CH_3)_4CO_3$), ammonium hydroxide ($NH_4OH$) and sodium hydroxide (NaOH), are particularly preferred. The pH of the cooling lubricant is preferably within the range of 7.0 to 12.5. Complexing agents, in particular those which form copper complexes, can furthermore be added. However, a particularly preferred cooling lubricant is also pure water without any additive.

The amounts of cooling lubricant that are fed to the working gap via the passage in the upper working disk are preferably within the range of between 0.2 and 50 l/min, and particularly preferably between 0.5 and 20 l/min. The values specified are mean values measured over a complete grinding treatment and relate to an effective working disk surface area of approximately 1.5 $m^2$, like that of, for example, the apparatus which is disclosed in DE 10007390 A1 and is suitable for carrying out the method according to the invention.

Preferably, the invention is used for machining semiconductor wafers made of monocrystalline silicon having a diameter of greater than or equal to 100 mm, most preferably having a diameter of 300 mm or greater. The preferred initial thickness prior to machining by the method is 500 to 1000 μm. For silicon wafers having a diameter of 300 mm, an initial thickness of 775 to 950 μm is particularly preferred.

The semiconductor wafers are machined after the separation of the semiconductor ingots into wafers (for example by means of a wire saw, band saw or internal-diameter saw) and prior to the concluding finish machining (for example by means of chemomechanical polishing). Further machining steps between separation and the method according to the invention or between the method according to the invention and the concluding finish machining can optionally be added without impairing the suitability of the claimed features for achieving the underlying object. These may be, for example, further mechanical, chemical or chemomechanical machining steps from groups b), c) and d) of the machining sequence for producing semiconductor wafers such as are specified in the prior art (see above).

The final thickness of the semiconductor wafers after machining is preferably 500 to 950 μm, and most preferably 775 to 870 μm. The total removal, i.e. the sum of the individual removals from both sides of the semiconductor wafer, preferably amounts to 7.5 to 120 μm, and most preferably 15 to 90 μm.

It is preferred for the grinding method to be preceded by a mechanical machining method in accordance with the prior art after the separation of the semiconductor ingot into wafers. It is furthermore preferred to permit the inventive grinding method to be succeeded by further fine machining methods in accordance with the prior art prior to the concluding finish machining. Finally, it is preferred to supplement the grinding method between ingot separation and finish machining by pre- and post-machining steps by methods in accordance with the prior art.

It is particularly preferred to subject the semiconductor wafers, directly after the separation of the ingot, to the grinding method of the invention, and subsequently to a chemomechanical polishing and furthermore not to carry out any further material-removing machining steps. What are to be understood as material-removing are, in particular, etching treatments, lapping treatments or grinding treatments in which the material thickness removed from the semiconductor wafers is greater than the thickness variation (TTV) remaining on the semiconductor wafers after the method according to the invention. Steps that are not material-removing in this sense, such as cleaning, etching, grinding or polishing steps with material removals of less than the thickness variation (TTV) remaining on the semiconductor wafers that have been machined according to the invention, or alternatively measuring steps, sorting steps and steps that do not significantly alter the area of the semiconductor wafers, such as, for example, edge rounding or polishing, are not intended to be excluded thereby.

Description of the Semiconductor Wafer According to the Invention

The result of the application of the inventive processing methods, in particular a suitable combination of some or preferably all of the methods, is a semiconductor wafer having a small thickness variation whose residual unevenness is not critically determined by a so-called "grinding navel" (local thickness decrease in the wafer center) or a so-called "edge roll-off" (thickness decrease in the edge region of the semiconductor wafer) and whose surface has a largely isotropic, in particular not centrosymmetrical or radially symmetrical, distribution of the machining traces referred to as grinding marks, and a roughness of less than 70 nm RMS.

The semiconductor wafer according to the invention has, in particular, the following advantageous properties:

an isotropic ground pattern, wherein regions with grinding marks that run parallel or symmetrically with respect to a point or an axis of symmetry relative to one another make up less than 10% of the entire surface of the semiconductor wafer. The determination of the degree of isotropy of the ground pattern is explained below.

Figure 12A:
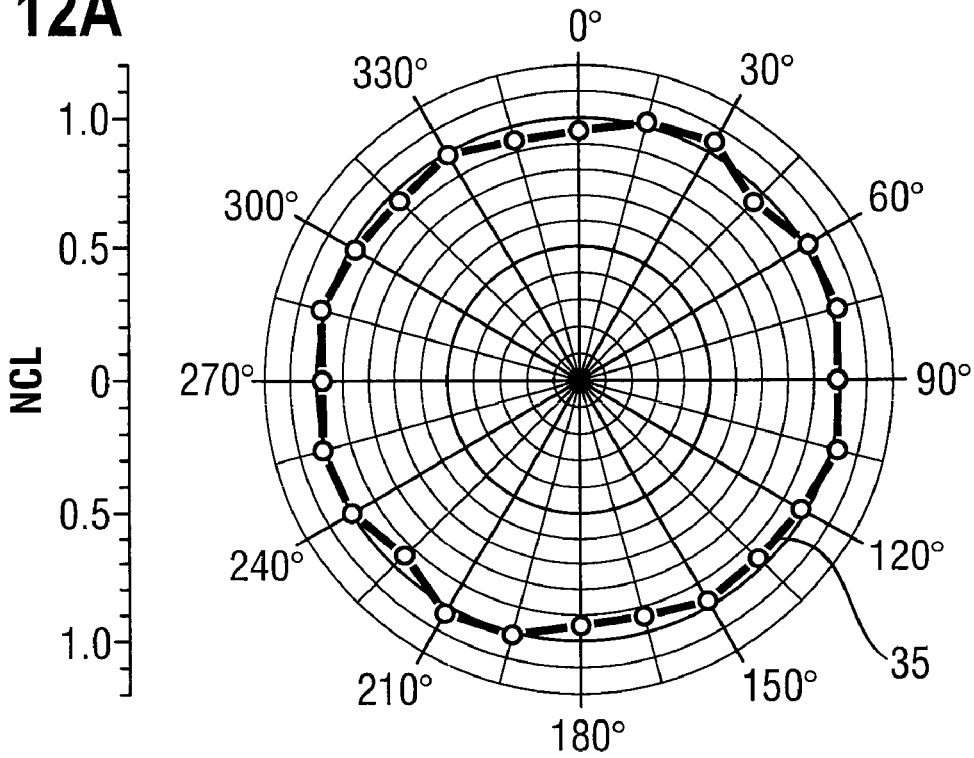
FIG. 12 illustrates the cumulated and normalized lengths of the machining traces (grinding marks) found on the ground semiconductor wafers as a function of their orientation with respect to the notch (0°) in the form of a histogram. (A): for a wafer obtained by the second method according to the invention; (B): a wafer obtained by a method not according to the invention.
Figure 12B:
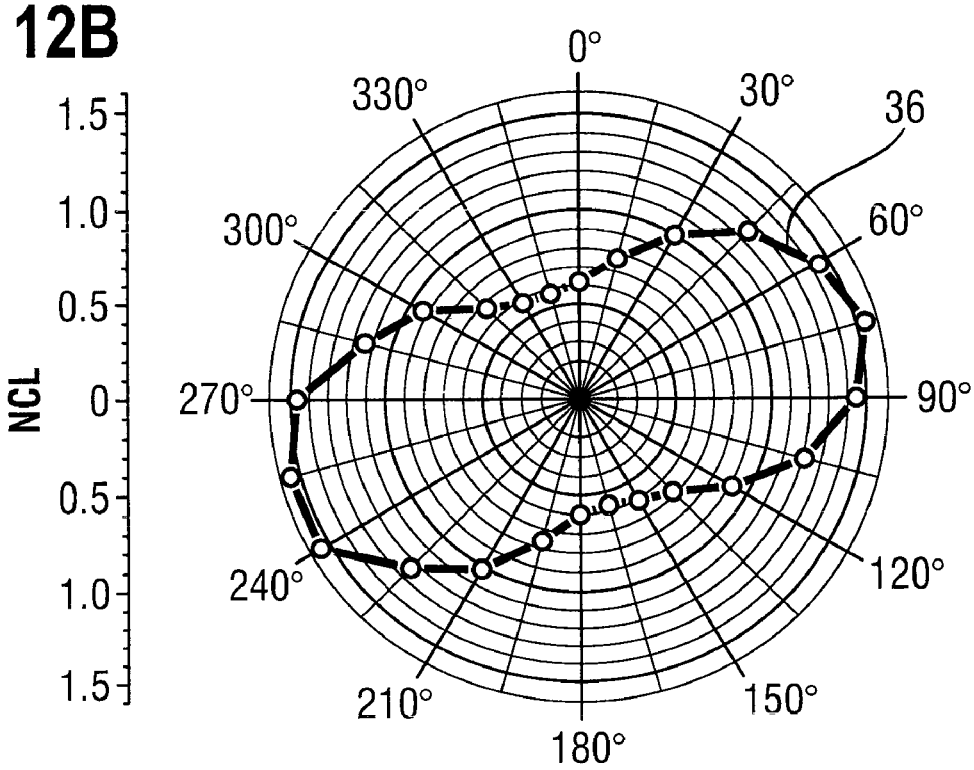

FIG. 12 shows the cumulated lengths of the grinding marks on a semiconductor wafer for each angle class as a measure of the isotropy of the machined semiconductor wafer (histogram in plane polar coordinates). The cumulated lengths are specified in a manner normalized to the average grinding mark length over all angles. FIG. 12(A) exhibits the largely uniformly distributed machining traces 35—in total are largely equal in length—of a semiconductor wafer with an isotropic ground pattern according to the invention (variation of the cumulated grinding mark lengths per angle class less than ±10% relative to the average cumulated grinding mark length over all angles). FIG. 12(B) represents the grinding mark histogram 36 of an anisotropic semiconductor wafer that is not according to the invention. In order to determine the values, the surface of a semiconductor wafer is visually inspected and the number allotted to each angle class (here: every 15°; within ±7.5°), multiplied by the length of the grinding marks, is determined. Since, in grinding methods, the size and depth of the grinding marks are similar to the dimensions of the abrasive grain used, such a method is reliable and practicable largely without ambiguity due to contributions of very fine or very coarse marks within the given limits (±10%). As an alternative, it is also possible, for example, to use a less complicated angularly resolved scattered light method in which the gloss of the semiconductor surface (non-specularly scattered light) is measured in angle-dependent fashion and its angular variation is used as a figure that is a measure of the isotropy of the surface. The angles are specified relative to the notch of the semiconductor wafer (notch=0°).

A thickness variation of less than 1 μm on the entire semiconductor wafer minus an edge exclusion of 1 mm, where a thickness variation of up to 50 nm or even less can be achieved. The term "thickness variation" should be understood in the sense of the customary parameter "TTV" (total thickness variation).

A thickness variation of less than 0.7 μm allotted to a region that lies at the edge of the semiconductor wafer and has a width of 1/10 of the diameter of the semiconductor wafer, where values of 50 nm or less can also be achieved. Consequently, the semiconductor wafer according to the invention has no appreciable edge roll-off.

A thickness variation of less than 0.3 μm allotted to a region that lies in the center of the semiconductor wafer and has a diameter of 1/5 of the diameter of the semiconductor wafer, where values of 50 nm or less can also be achieved. Consequently, the semiconductor wafer according to the invention has no appreciable grinding navel.

A warp and a bow of in each case less than 15 μm where values of 1 μm or less can also be achieved. The parameter "warp" is defined in accordance with ASTM F 1390 and DIN 50441-5, and the parameter "bow" is defined in accordance with ASTM F 534 and DIN 50441-5.

An RMS roughness of less than 70 nm, where values of 1 nm or less can also be achieved. The specified values relate to a correlation length range of 1 μm to 80 μm.

A depth of the crystal damage near the surface of less than 10 μm and through to 0.2 μm or less.

EXAMPLES

For bringing about the examples 1 to 4 described below with FIG. 4 to FIG. 7, an apparatus was used whose features that are relevant to the invention are described in DE 10007389 A1 and which has already been explained further above (polishing machine Peter Wolters AC-1500P3). For the examples specified below, various "Trizact® Diamond Tile" glass abrasive cloths were used as working layers, which were provided by 3M, USA, and are described for example in U.S. Pat. No. 6,007,407. The cloths are equipped in self-adhesive fashion on the rear side and were adhesively bonded onto the working disks of the double-side machining apparatus. The cloths used in the examples below were filled with diamond as abrasive. The grain size distribution was 2-6 μm. In the case of the cloths used in examples 1, 3 and 4, the abrasive was fixedly bonded according to the invention; it was only loose in example 2, however, with the result that the abrasive coating rapidly wore out and functioned as a "dispenser" for free grain (not according to the invention) in engagement with the workpieces.

300 mm silicon single-crystal wafers having an initial surface as obtained after separation (wire sawing) were used as workpieces. They had an initial thickness of 915 μm. The material removal was 90 μm in all of the examples, and the end thickness after machining was therefore 825 μm. The semiconductor wafers were inserted into carriers made of glass-fiber-reinforced epoxy resin (EP-GRP) which had an initial thickness of 800 μm (thickness decrease as a result of wear). The charge comprised in each case five carriers each with one semiconductor wafer. The pressure of the working disks during machining on the workpieces was about 340 daN and was increased or decreased so as to obtain removal rates of 10-20 μm/min on average.

Water (deionized ultrapure water) was used as a cooling lubricant, and was fed to the working gap at a rate of between 3 and 20 l/min via holes in the upper working disk.

Example 1

Figure 4:
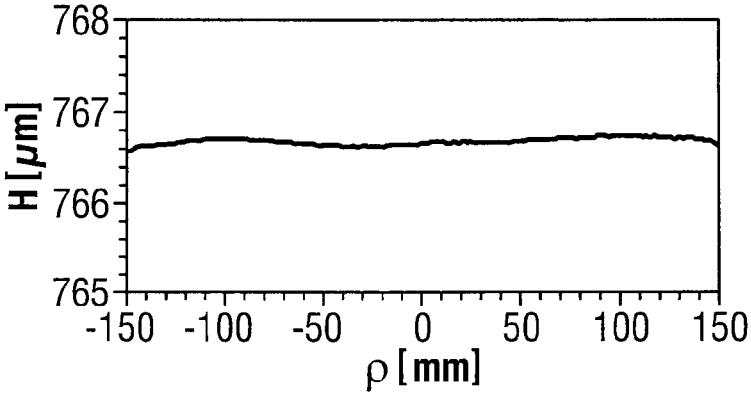
FIG. 4 represents the diametrical thickness profile of a semiconductor wafer made of monocrystalline silicon having a diameter of 300 mm which was subjected to a grinding method which incorporated all the features of the first, second, third, fourth and fifth embodiments of the invention. TTV=0.62 μm.

FIG. 4 shows the thickness profile of a semiconductor wafer made of monocrystalline silicon having a diameter of 300 mm which was obtained by machining by a method according to the invention having all the features of the first, second, third, fourth and fifth inventive methods. The thickness profile was determined by averaging 4 diametrically proceeding individual measurements at 0°, 45°, 90° and 135° relative to the orientation characteristic notch of the semiconductor wafer. The thickness variation over the entire semiconductor wafer (total thickness variation, TTV) is determined taking account of all the measured thickness values and amounts to 0.62 μm in this example. The thickness profiles were determined with the aid of a capacitive measuring method in which a pair of measuring probes opposite one another determines the distances with respect to the front and rear sides of the semiconductor wafer guided along between them. The edge exclusion (non-measurable edge region of the semiconductor wafer) is 1 mm. In the diagram, H denotes the thickness of the semiconductor wafer (in micrometers), and p denotes the radial position of the respective measured thickness value (in millimeters).

Example 2

Figure 5:
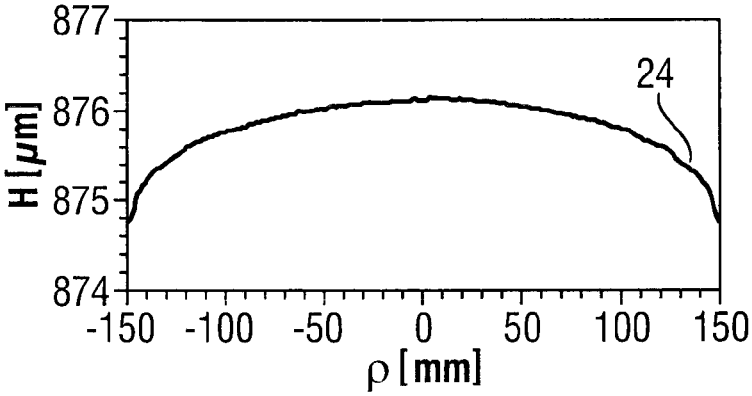
FIG. 5 represents the diametrical thickness profile of a semiconductor wafer made of monocrystalline silicon having a diameter of 300 mm which was subjected to a grinding method which incorporated all the features of the first, second, third, fourth and fifth embodiments of the invention. TTV=1.68 μm.

FIG. 5 shows the thickness profile of a semiconductor wafer that is not machined according to the invention. The material removal from the semiconductor wafer was predominantly effected by free (unbonded) grain during machining ("parasitic lapping"). On account of the transport—necessary for whole-area material removal—of the free grain from the free working gap over the edge of the semiconductor wafer to the center thereof and owing to the loss of the cutting capacity of the grain on this path (wear), a depletion of grain having removal ability occurs from the edge to the center of the semiconductor wafer. Therefore, the material removal is higher at the edge than in the center of the semiconductor wafer. This results in a convex form of the semiconductor wafer with the thickness decreasing toward the edge ("edge roll-off") 24. The TTV is 1.68 μm.

Example 3

Figure 6:
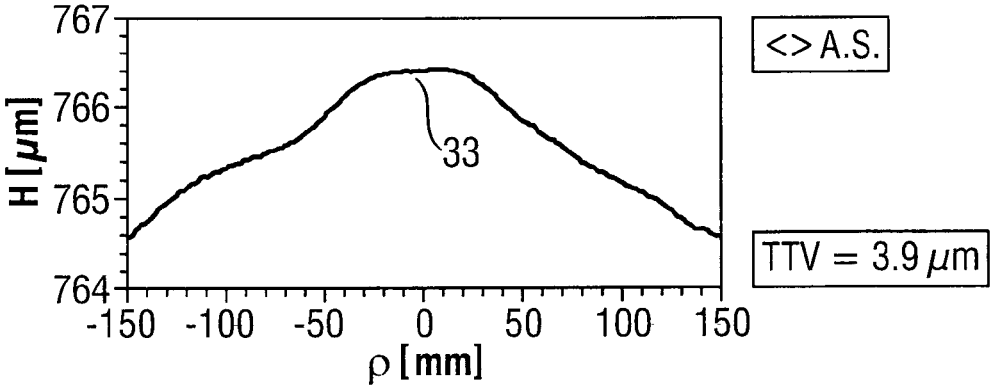
FIG. 6 represents the thickness profile of a semiconductor wafer which was subjected to a grinding method which incorporated all the features of the second, third, fourth and fifth embodiments of the invention. TTV=3.9 μm.

FIG. 6 shows the thickness profile of a semiconductor wafer after machining with an apparatus suitable for carrying out the claimed method in the manner according to the invention, but with working disks that are not according to the invention, namely deformed working disks.

Since the working disks are composed of different materials having correspondingly different coefficients of thermal expansion, a certain unavoidable deformation always occurs given an unsuitable choice of temperature on account of the "bimetal effect". Furthermore, such a disturbance of the plane-parallelism can be effected by time-dependent temperature input during the machining sequence itself, for example as a result of the machining work performed in the working gap 30 (which leads to heating); for a temperature gradient arises as a result from the machining zone 30 into the working disks 1 and 4, and deforms the working disks (in time-dependent fashion). The semiconductor wafers machined in this way have a pronounced convexity 33 (high thickness in the center region and small thickness in the edge region).

In the example shown in FIG. 6, during machining only inadequate measures have been taken for keeping the temperature in the working gap constant (unsuitable choice of the temperatures of the double cooling system of the working disk; insufficient control of temperature and quantity of the cooling lubricant (water) fed to the working gap). The TTV of the semiconductor wafer obtained in this example is 3.9 μm.

Example 4

Figure 7:
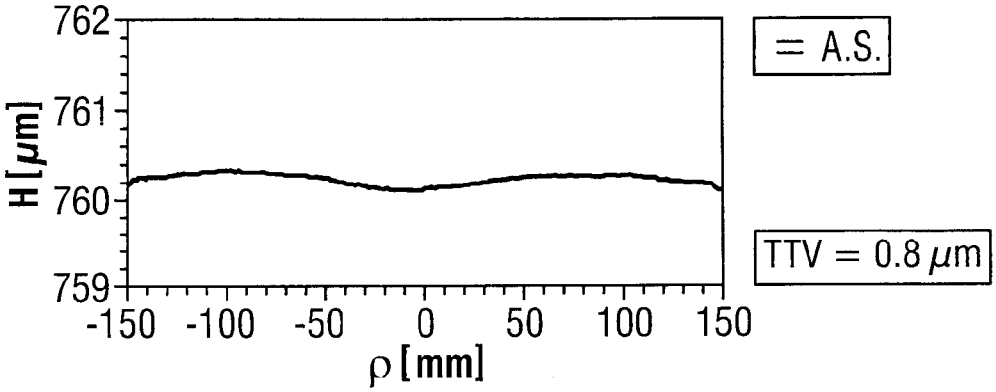
FIG. 7 represents the thickness profile of a semiconductor wafer which was subjected to a grinding method which incorporated all the features of the first, third, fourth and fifth embodiments of the invention. TTV=0.8 μm.

FIG. 7 shows the thickness profile of a semiconductor wafer after machining in an apparatus according to the invention, with uniform wear of the working layer (dimensional constancy) according to the invention and with temperature and working disk form kept constant according to the invention, but with a choice of kinematics that is not according to the invention. The magnitude of the difference between inherent rotational velocity of the carriers and circulating velocity of the carriers about the center of the rolling apparatus was somewhat greater in magnitude than the magnitude of the circulating velocity of the carriers relative to the working disks, with the result that the semiconductor wafers describe epitrochoids with respect to one working disk and hypotrochoids with respect to the other working disk. Since the drive speeds chosen in the example were outside but still close to the range according to the invention, the result is a still very good TTV of 0.8 μm.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for the simultaneous double-side grinding of a plurality of semiconductor wafers during which the wafer thickness is decreased, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein the magnitude of the ratio of the difference in the magnitudes of the theoretical wear $\mathcal{R}(r)$ of the two working layers to the mean value of the magnitudes of the wear of the two working layers for each radial position r is less than 1/1000, wherein the magnitude of the theoretical wear of each working layer is given by $$\mathcal{R}_i(r) = \left| \int_{e_{min}}^{e_{max}} \frac{\sqrt{a^2\sigma_i^2 + e^2\omega_i^2 + (r^2 - a^2 - e^2)\sigma_i\omega_i}}{\frac{\sigma_i - \omega_i}{2}\sqrt{2(a^2r^2 + e^2r^2 + a^2e^2) - r^4 - a^4 - e^4}} \cdot l(e) \cdot de \right| \Big/ \left( \frac{\sigma_i - \omega_i}{2} \cdot \frac{a^2 - e^2}{r^2} + \frac{\sigma_i + \omega_i}{2} \right)$$

where α indicates the pitch radius of the circulating movement of the carriers on the working disks about the midpoint of the rolling apparatus; e indicates the distance between the currently considered reference point and the midpoint of the corresponding carrier; l(e) indicates the arc length—running within the area of the semiconductor wafer—of the circle with radius e about the midpoint of the corresponding carrier; r indicates the radial position with respect to the midpoint of the working disks; $\sigma_i$ indicates the angular velocity of the circulation of the carriers about the midpoint of the working disks; $\omega_i$ indicates the angular angular velocity of the inherent rotation of the carriers about their respective midpoints, $e_{min}=\max\{0; e_{ecc}-R\}$ and $e_{max}=e_{ecc}+R$ where R=radius of the semiconductor wafer denote the lower and upper limits of the integration over e; $e_{ecc}$ indicates the eccentricity of the semiconductor wafer in the carrier and the index i=o for the upper working disk or i=u for the lower working disk indicates whether the angular velocities $\sigma_i$ and $\omega_i$ relate to the upper or the lower working disk.

2. The method of claim 1, wherein the change in the thickness homogeneity of each of the working layers on account of wear amounts to less than a hundredth of the magnitude of the thickness decrease of the semiconductor wafers during the simultaneous double-side grinding, wherein the thickness homogeneity of a working layer is defined as the difference between largest and smallest thickness over the entire area of the respective working layer that comes into contact with the semiconductor wafers.

3. The method of claim 1, wherein the proportion of the total material removal of material removal brought about by abrasive released in the course of the wear of the working layers is always less than the proportion of material removal brought about by abrasive fixedly bonded in the working layer.

4. The method of claim 3, wherein the thickness decrease of the working layers on account of wear during the simultaneous double-side grinding amounts to less than 10% of the thickness decrease of the semiconductor wafers.

5. The method of claim 3, wherein the thickness decrease of the working layers on account of wear during the simultaneous double-side grinding amounts to less than 2% of the thickness decrease of the semiconductor wafers.

6. The method of claim 1, wherein the temperature in a working gas between the two rotating working disks is kept constant during machining.

7. The method of claim 6, wherein at least 5% of the area of each semiconductor wafer is always in contact with the working layers during the simultaneous double-side grinding.

8. The method of claim 6, wherein the working layers are connected to the respective working disks in releasable fashion so as to be easily changeable.

9. The method of claim 8, wherein the working layers are connected to the respective working disks by adhesive bonding, by covering, magnetically, electrostatically, by means of vacuum, or by hook and loop fastener.

10. The method of claim 6, wherein a dressing block with a dressing grain whose grain size is equal to that of the abrasive grain used in a working layer is used for the dressing or trimming of the working layer.

11. The method of claim 10, wherein the working layer is dressed or trimmed predominantly by means of loose grain no longer bonded in the dressing block.

12. The method of claim 6, wherein the temperature in the working gap is kept constant by measuring the temperature in the working gap and varying the flow rate or the temperature or flow rate and temperature of the coolant, which flows through in each case at least one cooling labyrinth in each of the two working disks, according to the measured temperature.

13. The method of claim 6, wherein the temperature in the working gap is kept constant by measuring the temperature in the working gap and varying the flow rate or the temperature or flow rate and temperature of the cooling lubricant, which is fed to the working gap, according to the measured temperature.

14. The method of claim 1, wherein per unit time the magnitude of the number of revolutions of the carriers about the midpoint of the rolling apparatus and relative to each of the two working disks is greater than the magnitude of the number of revolutions of the individual carriers about their respective midpoints.

15. The method of claim 14, wherein the lengths of the trajectories which the semiconductor wafers cover relative to the two working disks are approximately identical.

16. The method of claim 15, wherein the magnitude of the ratio of the difference in the lengths of the trajectories which the semiconductor wafers cover relative to the two working disks and the mean value of the lengths of said trajectories is less

17. A method for the simultaneous double-side grinding of a plurality of semiconductor wafers during which the wafer thickness is decreased, wherein each semiconductor wafer lies such that it is freely moveable in a cutout of one of a plurality of carriers caused to rotate by means of a rolling apparatus and is thereby moved on a cycloidal trajectory, wherein the semiconductor wafers are machined in material-removing fashion between two rotating working disks, wherein each working disk comprises a working layer containing bonded abrasive, wherein for each working layer the magnitude of the theoretical wear $\mathcal{R}(r)$ for each radial position r deviates by less than 30% from the theoretical wear averaged over the entire working layer, where the magnitude of the theoretical wear of each working layer is given by $$\mathcal{R}_i(r) = \left| \int_{e_{min}}^{e_{max}} \frac{\sqrt{a^2\sigma_i^2 + e^2\omega_i^2 + (r^2 - a^2 - e^2)\sigma_i\omega_i}}{\frac{\sigma_i - \omega_i}{2}\sqrt{2(a^2r^2 + e^2r^2 + a^2e^2) - r^4 - a^4 - e^4}} \cdot l(e) \cdot de \right| \cdot \left( \frac{\sigma_i - \omega_i}{2} \cdot \frac{a^2 - e^2}{r^2} + \frac{\sigma_i + \omega_i}{2} \right)$$

where $\alpha$ indicates the pitch radius of the circulating movement of the carriers on the working disks about the midpoint of the rolling apparatus; e indicates the distance between the currently considered reference point and the midpoint of the corresponding carrier; l(e) indicates the arc length—running within the area of the semiconductor wafer—of the circle with radius e about the midpoint of the corresponding carrier; r indicates the radial position with respect to the midpoint of the working disks; $\sigma_i$ indicates the angular velocity of the circulation of the carriers about the midpoint of the working disks; $\omega_i$ indicates the angular velocity of the inherent rotation of the carriers about their respective midpoints, $e_{min}=\max\{0; e_{ecc}-R\}$ and $e_{max}=e_{ecc}+R$ where R=radius of the semiconductor wafer denote the lower and upper limits of the integration over e; $e_{ecc}$ indicates the eccentricity of the semiconductor wafer in the carrier and the index i=o for the upper working disk or i=u for the lower working disk indicates whether the angular velocities $\sigma_i$ and $\omega_i$ relate to the upper or the lower working disk. than 20% .

18. The method of claim 17 wherein the change in the thickness homogeneity of each of the working layers on account of wear amounts to less than a hundredth of the magnitude of the thickness decrease of the semiconductor wafers during the simultaneous double-side grinding, wherein the thickness homogeneity of a working layer is defined as the difference between largest and smallest thickness over the entire area of the respective working layer that comes into contact with the semiconductor wafers.

19. The method of claim 17, wherein the temperature in a working gas between the two rotating working disks is kept constant during machining.

20. The method of claim 19, wherein the temperature in the working gap is kept constant by measuring the temperature in the working gap and varying the flow rate or the temperature or flow rate and temperature of the coolant, which flows through in each case at least one cooling labyrinth in each of the two working disks, according to the measured temperature.

21. The method of claim 19, wherein the temperature in the working gap is kept constant by measuring the temperature in the working gap and varying the flow rate or the temperature or flow rate and temperature of the cooling lubricant, which is fed to the working gap, according to the measured temperature.

22. The method of claim 17 wherein per unit time the magnitude of the number of revolutions of the carriers about the midpoint of the rolling apparatus and relative to each of the two working disks is greater than the magnitude of the number of revolutions of the individual carriers about their respective midpoints.

23. The method of claim 22, wherein the lengths of the trajectories which the semiconductor wafers cover relative to the two working disks are approximately identical.

24. The method of claim 23, wherein the magnitude of the ratio of the difference in the lengths of the trajectories which the semiconductor wafers cover relative to the two working disks and the mean value of the lengths of said trajectories is less than 20%.

* * * * *

UNITED STATES PATENT AND TRADEMARK OFFICE

CERTIFICATE OF CORRECTION

PATENT NO. : 7,815,489 B2
APPLICATION NO. : 11/774675
DATED : October 19, 2010
INVENTOR(S) : Georg Pietsch et al.

It is certified that error appears in the above-identified patent and that said Letters Patent is hereby corrected as shown below:

Column 24, Line 29, Claim 1:

After "indicates the" delete "angular" (second occurrence).

Column 25, Line 41, Claim 16:

After "said trajectories is less." insert -- than 20%. --.

Column 26, Line 20, Claim 17:

After "the lower working disk." delete "than 20%".

Signed and Sealed this
First Day of February, 2011

David J. Kappos

David J. Kappos
*Director of the United States Patent and Trademark Office*